US012247291B2

(12) United States Patent
Takahashi

(10) Patent No.: US 12,247,291 B2
(45) Date of Patent: Mar. 11, 2025

(54) GRAIN-ORIENTED ELECTRICAL STEEL SHEET AND METHOD FOR MANUFACTURING GRAIN-ORIENTED ELECTRICAL STEEL SHEET

(71) Applicant: NIPPON STEEL CORPORATION, Tokyo (JP)

(72) Inventor: Fumiaki Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 606 days.

(21) Appl. No.: 17/421,164

(22) PCT Filed: Jan. 8, 2020

(86) PCT No.: PCT/JP2020/000341
§ 371 (c)(1),
(2) Date: Jul. 7, 2021

(87) PCT Pub. No.: WO2020/145317
PCT Pub. Date: Jul. 16, 2020

(65) Prior Publication Data

US 2022/0056585 A1 Feb. 24, 2022

(30) Foreign Application Priority Data

Jan. 8, 2019 (JP) ..... 2019-000926

(51) Int. Cl.
*C23C 18/12* (2006.01)
*C21D 8/12* (2006.01)
*C21D 9/46* (2006.01)

(52) U.S. Cl.
CPC ..... *C23C 18/1216* (2013.01); *C21D 8/1283* (2013.01); *C21D 8/1288* (2013.01); *C21D 9/46* (2013.01); *C23C 18/1241* (2013.01)

(58) Field of Classification Search
None
See application file for complete search history.

(56) References Cited

U.S. PATENT DOCUMENTS 3,856,568 A 12/1974 Tanaka et al.
4,293,350 A 10/1981 Ichiyama et al.
6,461,741 B1 10/2002 Takeda et al.

FOREIGN PATENT DOCUMENTS

EP 1149924 B1 * 7/2009 ..... C21D 8/12
JP 48-39338 A 6/1973
(Continued)

OTHER PUBLICATIONS

Translation—JP-07278832-A (JPH07278832-A)—Kanai et al.; Oct. 24, 1995 (Year: 1995).*
(Continued)

*Primary Examiner* — Humera N. Sheikh
*Assistant Examiner* — Elizabeth D Ivey
(74) *Attorney, Agent, or Firm* — Birch, Stewart, Kolasch & Birch, LLP

(57) ABSTRACT

Grain-oriented electrical steel sheet having an aluminum borate coating able to impart larger tension that the past and a method for manufacturing grain-oriented electrical steel sheet are formed. The grain-oriented electrical steel sheet according to the present invention has a steel sheet and an insulating coating formed on the steel sheet and containing aluminum and boron, where the oxides contain crystalline oxides and a maximum value of an emission intensity ratio of boron with respect to aluminum at an interface between the insulating coating and the steel sheet, analyzed by glow discharge optical emission spectrometry, is 2.5 times or more and 4.0 times or less of the emission intensity ratio of boron with respect to aluminum in the insulating coating.

2 Claims, 1 Drawing Sheet

(56) References Cited

FOREIGN PATENT DOCUMENTS

| | | | | |
|---|---|---|---|---|
| JP | 55-18566 | A | | 2/1980 |
| JP | 62-86175 | A | | 4/1987 |
| JP | 6-65754 | A | | 3/1994 |
| JP | H07278828 | A1 | * | 4/1994 |
| JP | 07278832 | A | * | 10/1995 |
| JP | 9-272983 | A | | 10/1997 |
| JP | 2002-309381 | A | | 10/2002 |
| JP | 2019-137874 | A | | 8/2019 |

OTHER PUBLICATIONS

Translation—JPH07278828-A1; Takahashi et al.; Apr. 13, 1994 (Year: 1994).*

* cited by examiner

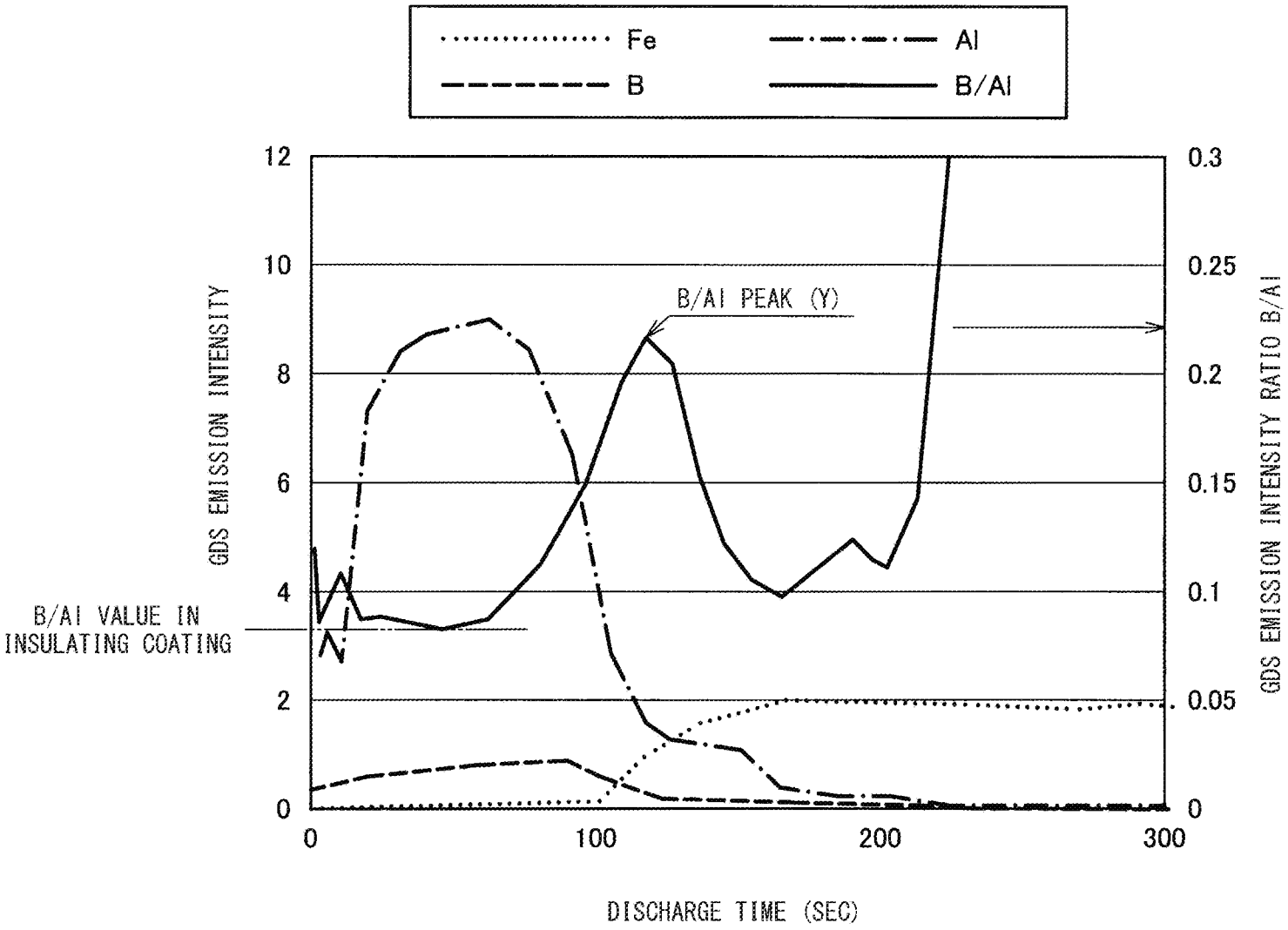
Fe
B
Al
B/Al
B/Al PEAK (Y)
B/Al VALUE IN INSULATING COATING
GDS EMISSION INTENSITY
GDS EMISSION INTENSITY RATIO B/Al
DISCHARGE TIME (SEC)
0
2
4
6
8
10
12
0
0.05
0.1
0.15
0.2
0.25
0.3
0
100
200
300

GRAIN-ORIENTED ELECTRICAL STEEL SHEET AND METHOD FOR MANUFACTURING GRAIN-ORIENTED ELECTRICAL STEEL SHEET

FIELD

The present invention relates to grain-oriented electrical steel sheet and a method for manufacturing grain-oriented electrical steel sheet.

BACKGROUND

Grain-oriented electrical steel sheet has a crystal structure with •110•<001> as its main orientation and is frequently used as a material for an iron core of a transformer. To reduce the energy loss, a material with a small iron loss has been demanded.

PTL 1 discloses, as a means for reducing the iron loss of grain-oriented electrical steel sheet, the method of laser beam radiation at the surface of the steel sheet after finish annealing to impart local stress and thereby subdivide the magnetic domains.

PTL 2 discloses means for subdividing magnetic domains whose effect does not disappear even after stress relief annealing (annealing for removing stress) after working the iron core.

On the other hand, iron alloy containing iron and silicon has large crystal magnetic anisotropy, so if applying external tension, subdivision of the magnetic domains occurs and the main factor of iron loss, that is, eddy current loss, can be lowered. In particular, it is known that imparting tension to steel sheet is effective for reducing the iron loss of grain-oriented electrical steel sheet containing 5% or less of silicon. This tension is imparted by the coating formed on the surface.

Grain-oriented electrical steel sheet is applied by a tension of about 10 MPa in the case of a thickness of 0.23 mm due to two layers of coatings of a primary coating comprised of mainly forsterite produced by reaction of the oxides at the surface of the steel sheet and the annealing separator in the finish annealing process and a secondary coating comprised of mainly an amorphous material produced by annealing on a coating solution comprised of mainly colloidal silica and a phosphate disclosed in PTL 3 etc.

As opposed to this, PTL 4 proposes grain-oriented electrical steel sheet having a coating mainly comprised of aluminum borate crystals on its surface.

CITATIONS LIST

Patent Literature

[PTL 1] Japanese Unexamined Patent Publication No. 55-018566

[PTL 2] Japanese Unexamined Patent Publication No. 62-86175

[PTL 3] Japanese Unexamined Patent Publication No. 48-39338

[PTL 4] Japanese Unexamined Patent Publication No. 6-65754

SUMMARY

Technical Problem

In the case of a conventional coating such as disclosed in PTL 3, it is possible to impart higher tension by increasing the coating weight. While the possibility of improvement of the iron loss by increase of tension remains, making the coating thicker than the present or more so as to increase the tension imparted causes a drop in the lamination factor, so is not preferable. For this reason, a coating which is excellent in adhesion, thin, and can impart large tension to steel sheet without causing a drop in the lamination factor is desired.

In order to develop a high tension coating, a high Young's modulus of the coating and a small heat expansion coefficient are necessary. In general, a crystalline substance is higher in Young's modulus than an amorphous substance. The coating comprised of aluminum borate described in PTL 4 is mainly comprised of a crystalline substance, so is higher in Young's modulus than a conventional amorphous coating comprised of silica and a phosphate. The heat expansion coefficient is also sufficiently low, so together with the effect of the Young's modulus, a higher tension can be obtained than by a coating such as disclosed in PTL 3.

However, a coating able to impart a higher tension has been required. To obtain a high tension coating by aluminum borate, sufficient aluminum borate crystals have to be produced in the coating. It would be ideal if the tension coating were comprised entirely by aluminum borate crystals, but in actuality, due to evaporation of elements from the surface at annealing, the elements in the coating unavoidably become uneven. If the distribution of elements is not suitable, it is believed that aluminum borate is not sufficiently formed and a high tension cannot be obtained, but the relationship between the distribution of elements and the tension has not been clear up to now.

The present invention has as its object to obtain grain-oriented electrical steel sheet having an aluminum borate coating able to impart higher tension than the past and a method for manufacturing grain-oriented electrical steel sheet.

Solution to Problem

The inventors thought that to obtain a higher tension by an aluminum borate coating, it would be necessary to clarify the relationship between the distribution of elements in the coating and the tension and clarify the conditions under which high tension is obtained. As a result of further study, higher coating tension can be obtained if the amount of boron near the interface of the coating and steel sheet is higher.

The present invention has been done based on the above experience and its summaries are as follows:

(1) Grain-oriented electrical steel sheet comprising a steel sheet and an insulating coating formed on the steel sheet and comprised of oxides containing aluminum and boron, where the oxides contain crystalline oxides and a maximum value of an emission intensity ratio of boron with respect to aluminum at an interface between the insulating coating and the steel sheet, analyzed by glow discharge optical emission spectrometry, is 2.5 times or more and 4.0 times or less of the emission intensity ratio of boron with respect to aluminum in the insulating coating.

(2) A method for manufacturing grain-oriented electrical steel sheet comprising:

a surface coating of a steel sheet with a coating solution containing a boron source and an aluminum source with a mass ratio converted to $Al_2O_3/B_2O_3$ of 1.8 to 2.6, annealing the steel sheet in an inert gas atmosphere with a dew point of 0 to 40° C. and containing hydrogen in 0 to 25 vol % to a predetermined temperature in a range of 450 to 600° C. by an average rate of temperature rise of 2 to 5° C./sec, then cooling it down to 200° C. or less by a cooling rate of 10° C./sec or more, and raising the temperature of the steel sheet up to 750° C. by a rate of temperature rise of an average 10 to 100° C./sec and annealing the steel sheet in the temperature region of 750 to 1000° C. for 20 to 120 sec.

Advantageous Effects of Invention

As mentioned above, according to the present invention, by controlling the amount of boron near the interface of the insulating coating and steel sheet, it is possible to obtain grain-oriented electrical steel sheet having an aluminum borate coating able to impart larger tension than the past.

BRIEF DESCRIPTION OF DRAWINGS

FIG. 1 is a glow discharge optical emission spectrometry chart of an insulating coating and steel sheet in one example of a grain-oriented electrical steel sheet in one embodiment of the present invention.

DESCRIPTION OF EMBODIMENTS

Below, while referring to the attached drawing, a preferred embodiment of the present invention will be explained in detail.

1. Grain-Oriented Electrical Steel Sheet

Below, grain-oriented electrical steel sheet according to the present embodiment will be explained. The grain-oriented electrical steel sheet according to the present embodiment has a steel sheet (base metal steel sheet) and an insulating coating formed on the steel sheet and comprised of oxides containing aluminum and boron.

The steel sheet which can be used in the present embodiment (base metal steel sheet) is not particularly limited so secondary recrystallization has been completed. As the steel sheet generally used as the base metal steel sheet, for example, steel sheet having a forsterite primary coating formed at the batch annealing (secondary recrystallization annealing) can be used in the present embodiment.

As mentioned above, an insulating coating comprised of oxides including aluminum and boron is formed on the surface of the steel sheet. Further, the oxides of the insulating coating include crystalline oxides. The maximum value of the emission intensity ratio B/Al of boron with respect to aluminum at the interface of the insulating coating and steel sheet, analyzed by glow discharge optical emission spectroscopy (GDS), is 2.5 times or more and 4.0 times or less of the emission intensity ratio B/Al of boron with respect to aluminum in the insulating coating. Due to this, the coating tension of the grain-oriented electrical steel sheet is increased. Below, this will be explained in detail based on the thinking of the inventors.

The inventors investigated improvement of the properties of the insulating coating. As a result, they discovered that by controlling the amount of boron near the interface of the insulating coating (tensile coating) and steel sheet, grain-oriented electrical steel sheet having a high tension is obtained. Specifically, they discovered that, regarding the emission intensity ratio of boron with respect to aluminum in the insulating coating, grain-oriented electrical steel sheet having an insulating coating exhibiting a high tension is obtained if the maximum value at the interface of the insulating coating and steel sheet is 2.5 times or more and 4 times or less in the insulating coating.

There are various methods for measuring the composition of an insulating coating in the depth direction, but an insulating coating including aluminum borate is comprised of boron, aluminum, and oxygen as constituents, so the method of glow discharge optical emission spectroscopy enabling easy analysis of these is suitable. Specifically, the analysis results are processed in the following way to quantify the distribution of elements in the insulating coating.

Al and B are analyzed for change in the emission intensity with respect to the spatter time by GDS, then the dependency of the ratio B/Al of emission intensities of the two (below, B/Al value) on the spatter time is obtained, but as shown in FIG. 1, it became clear that if the maximum value of the B/Al value near the interface of the insulating coating and the steel sheet (below, the "interface") (below, B/Al peak) is high, high tension of coating is obtained. Here, in the GDS chart in FIG. 1, the interface is defined as the span from where the emission intensity of the iron (Fe) is close to 0 to where it rises to a certain value. In FIG. 1, the region where the emission intensity of iron is near 0 is the analysis value in the insulating coating. Further, the region where the emission intensity of the iron is a value not 0 but is substantially constant is the analysis value in the steel sheet. Therefore, in the example shown in FIG. 1, the emission intensities from a discharge time of about 100 seconds when the emission intensity of iron rises from near 0 (near zero means a part of an intensity of 5% or less of the later explained constant value) to about 150 seconds when the emission intensity of iron becomes a constant value of about 2 (here, "constant value" means a value of a region where the change from the average value of 1 second before that is 0.05% of the average value of the emission intensity of iron in the steel sheet for 1 second) are the emission intensities corresponding to a region where the composition changes from the constituents of the coating to the constituents of the steel sheet. The B/Al peak defined in the present invention is the peak showing the highest value in that region. Therefore, the peak designated as the B/Al peak (Y) near the discharge time of 120 seconds in FIG. 1 is the B/Al peak defined in the present invention, while the peak near the discharge time of 10 seconds or near 190 seconds does not correspond to a B/Al peak defined in the present invention. An example of the analysis conditions of the glow discharge optical emission spectrometry for obtaining the emission intensities of Fe, B, and Al is shown in Table 1.

TABLE 1

Table 1. GDS Analysis Conditions

| | |
|---|---|
| Name of apparatus | Rigaku GDA750 Analyzer |
| RF output power | 30 W |
| Correction factor for quantification | 1 |
| Tune/load capacitor positions | Tune C1: 561, Load C2: 160, Automated Matching |
| Argon pressure | 3 hPa |

TABLE 1-continued

Table 1. GDS Analysis Conditions

| | |
|---|---|
| Data intervals | 0.04 second intervals, data rate 10% |
| Analysis region | 4 mmϕ |
| Sensitivity of each analyzed element (PMT level) | Fe (Fe2): 2, B: 2, Al: 2 |
| Emission analyzed at each element | Fe: 271.903 nm, B: 208.959 nm, Al: 396.152 nm |
| Photomultiplier current | Converted to current of 0 to 150 nA of photomultiplier tube |

In GDS, the ratio of the emission intensities of the elements is a value correlated with the ratio of composition of these elements at part of a spattered sample. Therefore, by measuring and calculating the B/Al values analyzed from the insulating coating and the ratio of the B/Al peaks near the interface of the insulating coating and steel sheet, it is possible to relatively observe the amount of boron near the interface between the insulating coating and the steel sheet compared with the insulating coating.

In the present invention, to obtain grain-oriented electrical steel sheet having an aluminum borate coating (insulating coating) excellent in tension imparting property, the value of the emission intensity of boron analyzed as mentioned above divided by the emission intensity of aluminum (emission intensity) is made a Y/X of 2.5 or more and 4.0 or less, where the value of B/Al in the insulating coating is made X and the value of the maximum value of the B/Al peak is made Y. Here, the value of X is the average value of the B/Al values for 1 second in the values of B/Al in the insulating coating in the region as a whole where the change from the average value of 1 second before that is 0.001 or less.

Y/X being 2.5 or more and 4.0 or less means that the B/Al value at the interface is larger than the B/Al value in the insulating coating. This means that if based on the amount of Al, the amount of B at the interface is higher relative to the amount of B in the insulating coating. While the reason why the tension becomes high if the value of Y/X is suitable is not clear, it is guessed that at the interface of the insulating coating with a high coating tension with the steel sheet, a large amount of aluminum borate crystals are formed. It is believed that a high tension is realized because of this. The reason is guessed to be as follows.

Boron oxide has a low melting point, so it is considered that in the insulating coating, at the parts with large amounts of boric acid, the melted boron oxides speed the diffusion of the elements. If the diffusion of the elements is fast, it is guessed that aluminum borate becomes easier to form, aluminum borate crystals are formed from a low temperature at annealing the insulating coating, and as a result the amount of aluminum borate crystals becomes larger. It is believed that the coating tension becomes higher if the amount of aluminum borate crystals becomes larger due to the above such mechanism. In the present invention, the amount of B was taken note of for securing the amount of boric acid at the interface, the B/Al value standardized by the amount of Al present in the same insulating coating was prescribed, and the lower limit of that value was made 2.5 times the value of the insulating coating. However, if the B/Al peak is too high, the amount of unreacted boron at the interface becomes larger and in a wet atmosphere, moisture easily reaches the surface of the steel sheet and sometimes rust is formed and other problems arise. Further, if the B/Al peak is too high, conversely sometimes the coating tension falls. The reason is guessed to be that if B collects at the interface too much, the boron becomes unevenly present in the insulating coating, aluminum borate crystals are insufficiently formed at part of the insulating coating, and the coating tension falls. Due to this, at the present invention, an upper limit is set for the value of the B/Al peak in the coating. If the value is made 4.0 times, a good result is obtained.

Y/X should be in the above-mentioned range, but to increase more the aluminum borate crystals at the interface of the insulating coating with the steel sheet and make the coating tension much larger, it is preferably 2.6 or more, more preferably 2.7 or more. Further, to suppress excessive boron at the interface of the insulating coating with the steel sheet and suppress a drop in coating tension, Y/X is preferably 3.8 or less, more preferably 3.5 or less.

The insulating coating of the grain-oriented electrical steel sheet according to the present embodiment may be made as thin as possible according to the objective since if too thick, the lamination factor of the base metal steel sheet in the grain-oriented electrical steel sheet falls. A thickness of 5% or less with respect to the thickness of the base metal steel sheet is preferable. More preferably it is 2% or less. Note that the coating thickness is the total thickness of the two surfaces of the steel sheet. If illustrated in the case of a thickness of the base metal steel sheet of 0.23 mm, the preferable 5% or less means a total of the two surfaces of 11.5•m or less and a value per side of 5.75•m or less. Similarly, the more preferable 2% or less means a total of the two surfaces of 4.6•m or less and a value per side of 2.3•m or less. Further, from the viewpoint of imparting tension, if making the thickness extremely small, a sufficient effect cannot be obtained. 0.1•m or more per side of the steel sheet is preferable. Note that, the thickness of the steel sheet is not limited. As one example, it may be 0.10 mm or more and 0.35 mm or less.

2. Method for Manufacturing Grain-Oriented Electrical Steel Sheet

Next, a method for manufacturing grain-oriented electrical steel sheet according to the present embodiment will be explained. The method for manufacturing grain-oriented electrical steel sheet according to the present embodiment comprises coating a surface of a steel sheet with a coating solution containing a boron source and an aluminum source with a mass ratio converted to $Al_2O_3/B_2O_3$ of 1.8 to 2.6, annealing the steel sheet in an inert gas atmosphere with a dew point of 0 to 40° C. and containing 0 to 25 vol % of hydrogen to a predetermined temperature in a range of 450 to 600° C. by an average rate of temperature rise of 2 to 5° C./sec, then cooling it down to 200° C. or less by a cooling rate of 10° C./sec or more, and raising the temperature of the steel sheet up to 750° C. by a rate of temperature rise of an average 10 to 100° C./sec and heat treating the steel sheet in the temperature region of 750 to 1000° C. for 20 to 120 sec.

The inventors investigated in detail the process conditions of the means for realizing the above-mentioned insulating coating. As a result of their study of the processes, it became clear that to form an insulating coating satisfying the above-mentioned conditions, it is sufficient to coat the base metal steel sheet of grain-oriented electrical steel sheet with a coating solution having a mass ratio $Al_2O_3/B_2O_3$ of aluminum oxide and boron oxide of 1.8 to 2.6 and limit the temperature and atmospheric conditions of the drying after coating and the heat treatment including the annealing temperature. The processes are comprised of (i) diffusion of the boron in during the rise in temperature after drying the coating solution and before crystallization of the aluminum borate, (ii) formation of nuclei of the aluminum borate crystals, and (iii) growth of the aluminum borate crystals.

Below, the method for manufacturing grain-oriented electrical steel sheet according to the present embodiment will be explained in detail while referring to the analysis in regard to the above processes (i) to (iii).

First, before the processes, the base metal steel sheet for forming the insulating coating is prepared. As the base metal steel sheet, the above-mentioned such steel sheet may be prepared, but specifically steel sheet which has been finish annealed and is formed with a forsterite primary coating on its surface by a conventional method may be prepared.

Next, such a base metal steel sheet is coated with a coating solution for forming an insulating coating. The coating solution contains a boron source and aluminum source in a mass ratio converted to $Al_2O_3/B_2O_3$ of 1.8 to 2.6.

As the boron source, o-boric acid represented by $H_3BO_3$ is the most preferable from the viewpoint of the work efficiency, price, etc., but m-boric acid represented by $HBO_2$, boron oxide represented by $B_2O_3$, or mixtures of the same may also be used.

As the aluminum source, aluminum oxide or an aluminum oxide precursor may be mentioned. As the aluminum oxide precursor compound, for example, a hydrate of aluminum oxide as represented by $Al_2O_3 \cdot mH_2O$ such as boehmite, aluminum hydroxide, etc. aluminum nitrate, aluminum chloride, and other various types of aluminum salts etc. are preferably used.

Further, the boron source and the aluminum source in the coating solution are contained so that the mass volume converted to $Al_2O_3/B_2O_3$ becomes 1.8 to 2.6. Due to this, it is possible to form the above insulating coating by a suitable ratio of composition. As opposed to this, if the above mass ratio is less than 1.8, the amount of boron in the insulating coating becomes too large and as a result boron collects too much at the interface, the boron becomes unevenly present in the insulating coating, aluminum borate crystals are insufficiently formed at part of the insulating coating, and the coating tension falls. Further, if the above mass ratio becomes over 2.6, the aluminum source becomes too large and as a result the amount of boron near the interface of the insulating coating and the base metal steel sheet becomes insufficient, fewer aluminum borate crystals are formed, and the coating tension does not become higher.

The above mass ratio is preferably 1.9 or more and 2.4 or less, more preferably 2.0 or more and 2.2 or less.

A slurry is prepared as a coating solution by making these materials disperse in a dispersion medium. As the dispersion medium, water is best, but so long there is no obstacle in the other processes, an organic solvent or mixtures of the same can also be used. The solid concentration of the slurry is suitably selected in accordance with the work efficiency etc. and is not particularly limited.

Further, by using a fine particle dispersion called a "sol" as the aluminum oxide precursor in this slurry, sometimes a thin, uniform, and excellent adhesion insulating coating is obtained. This would be particularly remarkable in a case where there is no nonmetallic substance on the surface of the steel sheet and an insulating coating is directly formed on the metal surface of the steel sheet.

If using a sol for the coating solution, as an aluminum oxide precursor, one called the above-mentioned boehmite sol and/or alumina sol would be particularly suitable from the viewpoint of work efficiency or price etc.

Note that the coating solution may include constituents other than the above in a range not impairing the effect exhibited by the present invention.

The obtained slurry (coating solution) is coated on the surface of the grain-oriented electrical steel sheet finished being finish annealed by a roll coater or other coater, the dip method, spray blowing, electrophoresis, or another conventionally known method.

Note that before coating, the coating solution may for example be held at a temperature of 20° C. or more and 40° C. or less so as to prevent the precipitation of boric acid and evaporation of excessive moisture. If the temperature of the coating solution is too low, depending on the type and concentration of the boron source, boric acid will precipitate in the coating solution, while if the temperature is too high, the water content easily become lower, normal coating becomes impossible, and in any case, the targeted coating sometimes can no longer be obtained.

Next, in an inert gas atmosphere with a dew point of 0 to 40° C. and containing 0 to 25 vol % of hydrogen, the steel sheet is heated up to a predetermined temperature in the range of 450 to 600° C. at an average rate of temperature rise of 2 to 5° C./sec. The coating solution is heated and dried in a temperature region from room temperature to the predetermined temperature between 450 to 600° C. After finishing being dried, the film-like substance comprised of a mixture of a boron compound and aluminum compound formed on the base metal steel sheet is heated.

The rate of temperature rise up to the predetermined temperature in the range of 450 to 600° C., in regard to the process (i), is limited to 2 to 5° C./sec so as to make the boron sufficiently diffuse. If the rate of temperature rise is too fast, the boron insufficiently diffuses and the targeted composition and amount of the water soluble constituents cannot be obtained. In addition, coating defects easily form due to boiling at the time of drying the coating solution. On the other hand, if too slow, the boron proceeds to evaporate too much and as a result an insulating coating of the targeted composition can no longer be obtained.

Note that, the peak temperature at the heating of the steel sheet may be 450° C. or more and 600° C. or less, but preferably is 480° C. or more and 530° C. or less. Due to this, it is possible to make boron sufficiently diffuse in suppressing evaporation of boron and possible to suppress formation of unrequired crystals.

Further, as the inert gas in the atmosphere at the time of heating, for example, nitrogen or helium, argon, xenon, or other rare gas may be mentioned. Among these, for keeping down the costs as well, nitrogen is preferable.

Further, the atmosphere at the time of heating includes 0 to 25 vol % of hydrogen. Due to this, it is possible to keep down oxidation between the steel sheet and the insulating coating and secure adhesion. As opposed to this, there is no problem even if the content of hydrogen is over 25 vol %, but this is not preferable from the viewpoint of it being too costly.

Further, the dew point of the atmosphere at the time of heating is 0° C. or more and 40° C. or less. If the dew point is less than 0° C., the tension of the insulating coating cannot be sufficiently secured. Further, if the above dew point is over 40° C., there is the problem that oxidation easily occurs at the interface of the steel sheet and the insulating coating and the adhesion becomes poor. The dew point of the atmosphere at the time of heating is preferably 10° C. or more and 30° C. or less.

Next, the steel sheet is heated by the above-mentioned rate of temperature rise, then is cooled down to 200° C. or less by a cooling rate of 10° C./sec or more. The reason is not clear, but regarding the above mentioned process (ii), due to such cooling treatment, it is guessed that formation of nuclei of aluminum borate crystals is promoted. If the cooling temperature is not 200° C. or less or if the cooling rate is less than 10° C./sec, a sufficient coating tension cannot be obtained. The cooling temperature may be 200° C. or less, but from the viewpoint of the costs and required time, it is not preferable to make the temperature excessively low. Preferably, it is 100° C. or more and 200° C. or less. Further, the cooling rate may be 10° C./sec or more, but if too fast, uniform cooling becomes difficult, so preferably it is 10° C./sec or more and 150° C./sec or less. Note that, usually, the steel sheet is cooled right after heating at the above-mentioned rate of temperature rise.

Next, the steel sheet is raised in temperature up to 750° C. by a rate of temperature rise of an average of 10 to 100° C./sect and is heat treated in the temperature region of 750 to 1000° C. for 20 to 120 seconds. By annealing the coated steel sheet at 750° C. or more after drying in this way, an oxide coating is formed as an insulating coating on the surface.

Further, as mentioned above, by raising the temperature of the steel sheet up to 750° C. by an average rate of temperature rise of 10 to 100° C./sec, relating to the above-mentioned process (i), it is possible to suppress evaporation of boron. That is, in the 600° C. or more temperature region, in particular the evaporation of boron easily proceeds, so the steel sheet is raised in temperature by a relatively fast speed as mentioned above. If the rate of temperature rise is slow, the boron proceeds to evaporate and an insulating coating of the targeted composition can no longer be obtained. There is no problem even if the rate of temperature rise is fast, but even if over 100° C./sec, no improvement is seen even compared with the case of a lower rate of temperature rise. Further, rapid temperature rise can also become a factor pushing up capital costs. Therefore, the substantive upper limit of the rate of temperature rise is 100° C./sec. The rate of temperature rise is preferably 50° C./sec or more and 80° C./sec or less.

Heat treatment has to be performed for 20 to 120 seconds between 750 to 1000° C. because, regarding the above-mentioned process (iii), crystal growth of aluminum borate occurs at 750° C. or more and crystallization proceeds. If the temperature and time are not in the above ranges, the crystallization of the aluminum borate does not sufficiently proceed and sufficient tension can no longer be obtained. Further, if the annealing temperature (heat treatment temperature) is less than 750° C., sometimes the coated precursor will not become oxides. Further, the annealing temperature is low, so sufficient tension is not obtained. This is not preferable.

The heat treatment temperature may be inside the above range, but from the viewpoint of the balance of the effect on the increase of tension and the cost, it is preferably 800° C. or more and 950° C. or less. Further, the heat treatment temperature should be in the above-mentioned range, but is preferably 50 seconds or more and 90 seconds or less.

Note that if raising the temperature to over 750° C., the time from the point of time over 750° C. to next becoming less than 750° C. is made the heat treatment time.

The atmosphere at annealing (at the time of temperature rise and heat treatment) is preferably a nitrogen or other inert gas atmosphere, a nitrogen-hydrogen mixed atmosphere, or other reducing atmosphere. Air or an atmosphere excessively containing oxygen may cause the steel sheet to excessively oxidize. This is not preferable.

Regarding the dew point of the atmospheric gas, good results are obtained at 0 to 40° C.

Alternatively, the atmosphere at the time of annealing may be the same as the atmosphere at the time of drying the coated solution.

By doing this, grain-oriented electrical steel sheet having a high tension having the above such insulating coating is obtained.

EXAMPLES

Below, the present invention will be explained in more detail based on examples, but Example 1 shown below is just one illustration of the present invention. The present invention is not limited to only the examples.

Example 1

A commercially available boric acid reagent and aluminum oxide ($Al_2O_3$) powder (mean particle size: 0.4•m) were mixed in the ratio shown in Table 2. Note that, the boric acid was weighed converted to boron oxide ($B_2O_3$) equivalents. Distilled water was added to this to prepare a slurry.

The obtained slurry was coated on grain-oriented silicon steel sheet (with primary coating made of forsterite) containing Si: 3.2%, having a thickness of 0.23 mm, and finished being finish annealed so as to give a mass of coating after annealing of 4.5 g/m$^2$. After that, under the conditions shown in Table 2, this was dried, cooled, then raised in temperature to 750° C., and annealed on at this temperature for an annealing time of 100 seconds to form an insulating coating. The peak temperature of the steel sheet at the time of drying was made 500° C. The atmosphere at the time of drying, cooling, temperature rise, and annealing was a nitrogen atmosphere containing 10% hydrogen. The dew point was made 30° C.

A sample formed with the insulating coating was analyzed by X-ray diffraction. The presence of crystalline aluminum borate was confirmed by the diffracted rays.

The coating on one side of the steel sheet formed with the insulating coating was removed and the tension of the coating was calculated from the curvature of the steel sheet. This tension is the tension of only the aluminum borate coating not containing a forsterite layer. For removal of the insulating coating, a sodium hydroxide aqueous solution was used. A tension of 15 MPa or more was defined as a high tension. From the results of Table 2, it is learned that in this example, an insulating coating with a high tension is obtained.

TABLE 2

| | Control factor | | | | | | | | |
|---|---|---|---|---|---|---|---|---|---|
| | Composition of coating solution (weight g) | | | Average rate of temp. rise | | Cooling rate down | Average rate of temp. rise | Property | |
| Test no. | Aluminum oxide ($Al_2O_3$) | Boric acid ($B_2O_3$ equivalent) | $Al_2O_3$/$B_2O_3$ | up to 500° C. (° C./sec) | Cooling temperature (° C.) | to cooling temperature (° C./sec) | up to 750° C. (° C./sec) | Coating tension (MPa) | Class |
| 1 | 100 | 45.3 | 2.2 | 3 | 100 | 130 | 50 | 17 | Ex. |
| 2 | 100 | 45.3 | 2.2 | 3 | 100 | 80 | 50 | 16 | Ex. |
| 3 | 100 | 45.3 | 2.2 | 3 | 100 | 20 | 50 | 16 | Ex. |
| 4 | 100 | 45.3 | 2.2 | 3 | 100 | 16 | 50 | 15 | Ex. |
| 5 | 100 | 45.3 | 2.2 | 3 | 100 | 13 | 50 | 15 | Ex. |
| 6 | 100 | 45.3 | 2.2 | 3 | 200 | 60 | 50 | 16 | Ex. |

TABLE 2-continued

| | Control factor | | | | | | | | |
|---|---|---|---|---|---|---|---|---|---|
| | Composition of coating solution (weight g) | | | Average rate of temp. rise | | Cooling rate down | Average rate of temp. rise | Property | |
| Test no. | Aluminum oxide ($Al_2O_3$) | Boric acid ($B_2O_3$ equivalent) | $Al_2O_3$/$B_2O_3$ | up to 500° C. (° C./sec) | Cooling temperature (° C.) | to cooling temperature (° C./sec) | up to 750° C. (° C./sec) | Coating tension (MPa) | Class |
| 7 | 100 | 45.3 | 2.2 | 3 | 200 | 10 | 50 | 15 | Ex. |
| 8 | 100 | 45.3 | 2.2 | 3 | 100 | 8 | 50 | 12 | Comp. ex. |
| 9 | 100 | 45.3 | 2.2 | 3 | 200 | 8 | 50 | 11 | Comp. ex. |
| 10 | 100 | 45.3 | 2.2 | 3 | 300 | 13 | 50 | 12 | Comp. ex. |
| 11 | 100 | 45.3 | 2.2 | 3 | 300 | 8 | 50 | 12 | Comp. ex. |
| 12 | 100 | 45.3 | 2.2 | 3 | 400 | 14 | 50 | 11 | Comp. ex. |
| 13 | 100 | 45.3 | 2.2 | 3 | 500 | — | 50 | 12 | Comp. ex. |
| 14 | 100 | 55.6 | 1.8 | 3 | 200 | 10 | 50 | 17 | Ex. |
| 15 | 100 | 38.4 | 2.6 | 3 | 200 | 10 | 50 | 16 | Ex. |
| 16 | 100 | 57.1 | 1.75 | 3 | 200 | 10 | 50 | 10 | Comp. ex. |
| 17 | 100 | 37.0 | 2.7 | 3 | 200 | 10 | 50 | 9 | Comp. ex. |
| 18. | 100 | 45.3 | 2.2 | 4 | 200 | 10 | 50 | 15 | Ex. |
| 19 | 100 | 45.3 | 2.2 | 3 | 200 | 10 | 50 | 16 | Ex. |
| 20 | 100 | 45.3 | 2.2 | 5 | 200 | 10 | 50 | 16 | Ex. |
| 21 | 100 | 45.3 | 2.2 | 6 | 200 | 10 | 50 | 11 | Comp. ex. |
| 22 | 100 | 45.3 | 2.2 | 1 | 200 | 10 | 50 | 12 | Comp. ex. |
| 23 | 100 | 45.3 | 2.2 | 5 | 200 | 10 | 100 | 17 | Ex. |
| 24 | 100 | 45.3 | 2.2 | 2 | 200 | 10 | 10 | 16 | Ex. |
| 25 | 100 | 45.3 | 2.2 | 2 | 200 | 10 | 5 | 11 | Comp. ex. |

Example 2

To 100 g of a commercially available aluminum oxide ($Al_2O_3$) powder (mean particle size: 0.4•m), a boric acid reagent was mixed in 45.3 g by equivalent of boron oxide ($B_2O_3$). To this, distilled water was added to prepare a slurry. $Al_2O_3$/$B_2O_3$ was 2.2

This slurry was coated on grain oriented silicon steel sheet (having a forsterite primary coating) containing Si in 3.2%, having a thickness of 0.23 mm, and finished being finish annealed to give a weight of the coating after annealing of 4.5 g/m$^2$. This was raised in temperature in a nitrogen atmosphere having a dew point of 30° C. and containing 10 vol % of hydrogen up to 500° C. by an average 3° C./sec, then was cooled down to 200° C. by 60° C./sec, then was raised up to the annealing temperature by an average of 50° C./sec and annealed under the conditions shown in Table 3 to form an insulating coating.

In the same way as Example 1, the coating on one side of the steel sheet formed with the insulating coating was removed and the tension of the coating was calculated from the curvature of the steel sheet. This tension is the tension of only the aluminum borate coating not containing the forsterite layer. For removal of the insulating coating, a sodium hydroxide aqueous solution was used. A tension of 15 MPa or more was defined as a high tension. From the results of Table 3, it is learned that in this example, an insulating coating with a high tension is obtained.

TABLE 3

| | Control factor | | Property | | |
|---|---|---|---|---|---|
| Test no. | Annealing temperature (° C.) | Annealing time (sec) | Size of B/Al peak value with respect to B/Al value in coating | Coating tension (MPa) | Class |
| 26 | 750 | 120 | 3.4 | 15 | Ex. |
| 27 | 750 | 20 | 3.2 | 15 | Ex. |
| 28 | 900 | 100 | 2.9 | 16 | Ex. |

TABLE 3-continued

| | Control factor | | Property | | |
|---|---|---|---|---|---|
| Test no. | Annealing temperature (° C.) | Annealing time (sec) | Size of B/Al peak value with respect to B/Al value in coating | Coating tension (MPa) | Class |
| 29 | 900 | 70 | 3.1 | 16 | Ex. |
| 30 | 900 | 20 | 3.2 | 17 | Ex. |
| 31 | 1000 | 120 | 2.6 | 18 | Ex. |
| 32 | 1000 | 20 | 2.9 | 18 | Ex. |
| 33 | 750 | 140 | 2.1 | 10 | Comp. ex. |
| 34 | 700 | 120 | 2.3 | 8 | Comp. ex. |
| 35 | 700 | 20 | 2.3 | 7 | Comp. ex. |
| 36 | 750 | 10 | 2.4 | 10 | Comp. ex. |
| 37 | 1000 | 10 | 2.3 | 10 | Comp. ex. |
| 38 | 1000 | 140 | 2.2 | 11 | Comp. ex. |

Above, a preferred embodiment of the present invention was explained in detail while referring to the attached FIGURE, but the present invention is not limited to the illustrations. A person having ordinary knowledge in the technical field to which the present invention belongs clearly can conceive of various changes and corrections within the range of the technical idea described in the claims. These are also naturally understood as falling in the technical scope of the present invention.

The invention claimed is:

1. Grain-oriented electrical steel sheet comprising a steel sheet and an insulating coating formed on the steel sheet and consisting of oxides of aluminum and boron, where the oxides comprise crystalline oxides and a maximum value of an emission intensity ratio of boron with respect to aluminum at an interface between the insulating coating and the steel sheet, analyzed by glow discharge optical emission spectrometry, is 2.5 times or more and 4.0 times or less of an emission intensity ratio of boron with respect to aluminum in the insulating coating.

2. A method for manufacturing the grain-oriented electrical steel sheet according to claim 1, comprising:

coating a surface of a steel sheet with a coating solution comprising a boron source and an aluminum source with a mass ratio converted to $Al_2O_3/B_2O_3$ of 1.8 to 2.6, annealing the steel sheet in an inert gas atmosphere with a dew point of 0 to 40° C. and comprising hydrogen in 0 to 25 vol % to a predetermined temperature in a range of 450 to 600° C. by an average rate of temperature rise of 2 to 5° C./sec, then cooling it down to 200° C. or less by a cooling rate of 10° C./sec or more, and raising the temperature of the steel sheet up to 750° C. by a rate of temperature rise of an average 10 to 100° C./sec and annealing the steel sheet in the temperature region of 750 to 1000° C. for 20 to 120 sec.

* * * * *